United States Patent [19]

Seybold

[11] 3,955,541

[45] May 11, 1976

[54] ROTARY INTERNAL COMBUSTION ENGINE WITH UNIFORMLY ROTATING PISTONS COOPERATING WITH REACTION ELEMENTS HAVING A VARYING SPEED OF ROTATION

[76] Inventor: Frederick W. Seybold, 1979 Dogwood Drive, Scotch Plains, N.J. 07076

[22] Filed: Apr. 15, 1974

[21] Appl. No.: 461,167

[52] U.S. Cl. ..... 123/8.47; 418/34; 418/37

[51] Int. Cl.[2] ..... F02B 53/00

[58] Field of Search ..... 418/34, 33, 35, 37; 123/8.47; 74/112, 63, 822; 308/207 A

[56] References Cited

UNITED STATES PATENTS

| | | | |
|---|---|---|---|
| 1,481,220 | 1/1924 | Nichols | 418/34 X |
| 1,543,147 | 6/1925 | Zimmerman | 308/207 A |
| 1,556,843 | 10/1925 | Kinder | 418/34 X |
| 1,867,582 | 7/1932 | McCray | 308/207 A |
| 2,182,269 | 12/1939 | Whritenour | 123/8.47 |
| 2,270,976 | 1/1942 | Sobek | 418/37 X |

FOREIGN PATENTS OR APPLICATIONS

| | | | |
|---|---|---|---|
| 587,989 | 1/1925 | France | 123/8.47 |

*Primary Examiner*—Carlton R. Croyle
*Assistant Examiner*—Michael Koczo, Jr.

[57] ABSTRACT

A rotary internal combustion engine comprising a stationary, water cooled housing having a large cylindrical bore in which a hollow cylinder with end walls rotates. On said cylinder a pair of wedge-shaped pistons is mounted diametrically opposed to similar reactor elements carried by a multiple splined shaft, said reactor elements remaining stationary during ignition and expansion and they are then accelerated by a novel crank mechanism to reduce the gap between the pistons and the reactor elements to exhaust the burned gases and/or compress the intake mixture of gas and air before ignition takes place.

3 Claims, 22 Drawing Figures

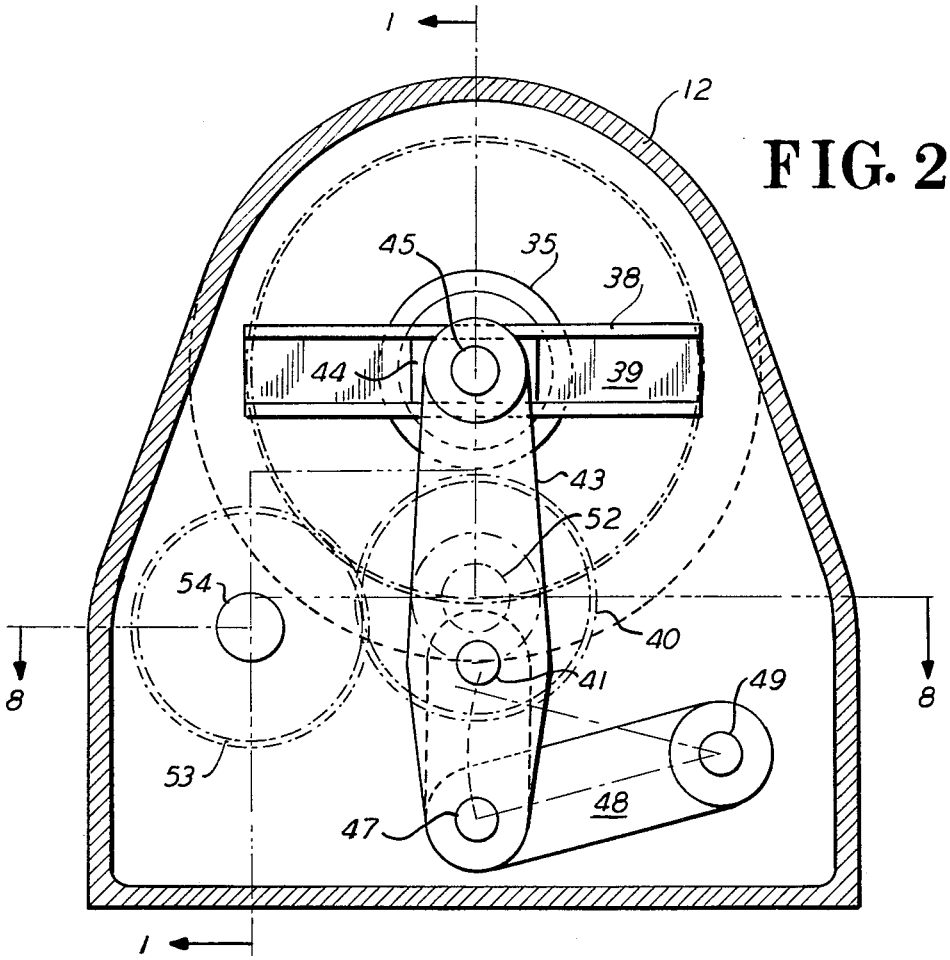
FIG. 2
FIG. 8
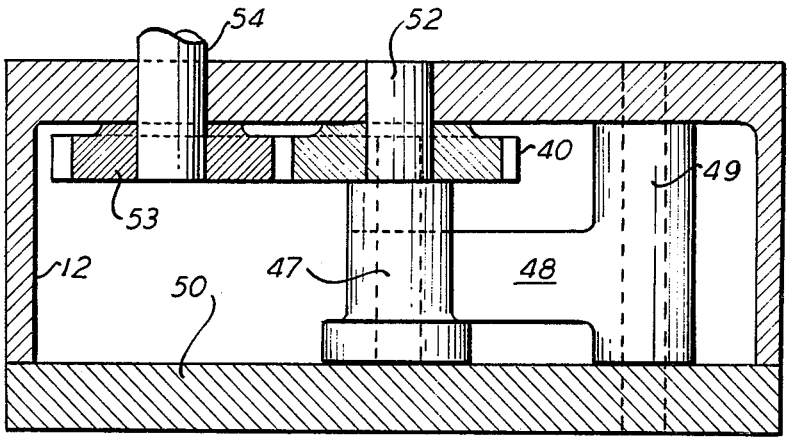

FIG. 5
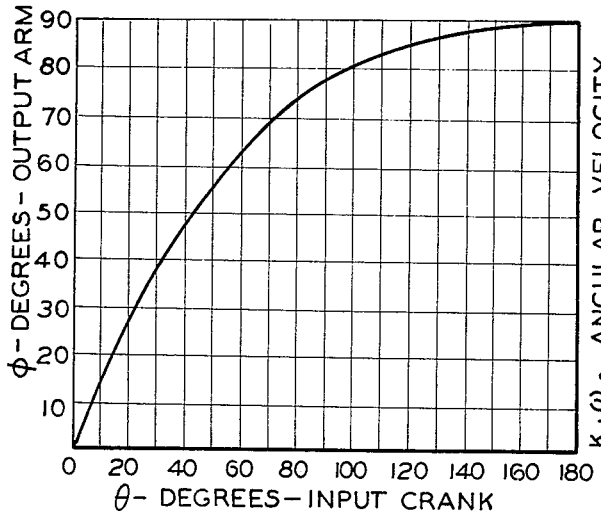
FIG. 6
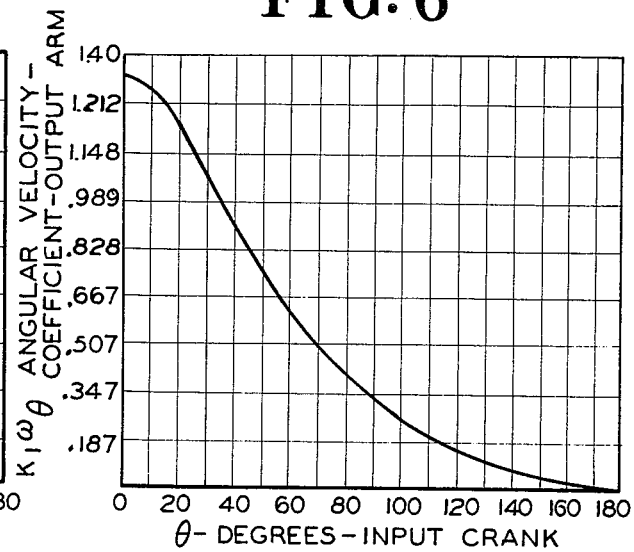
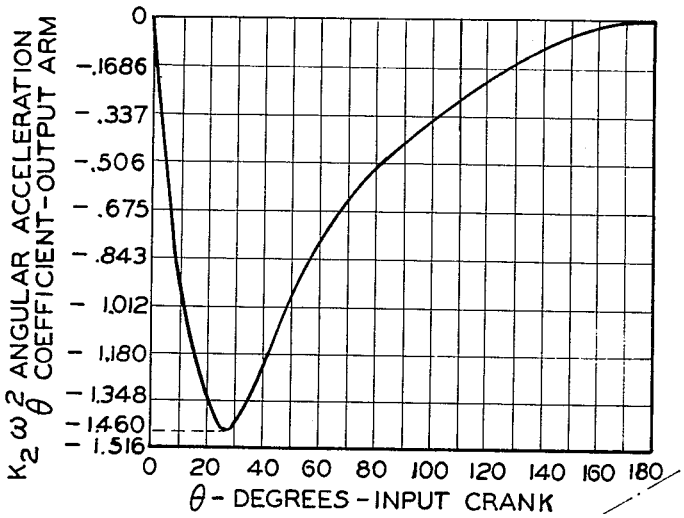
FIG. 7
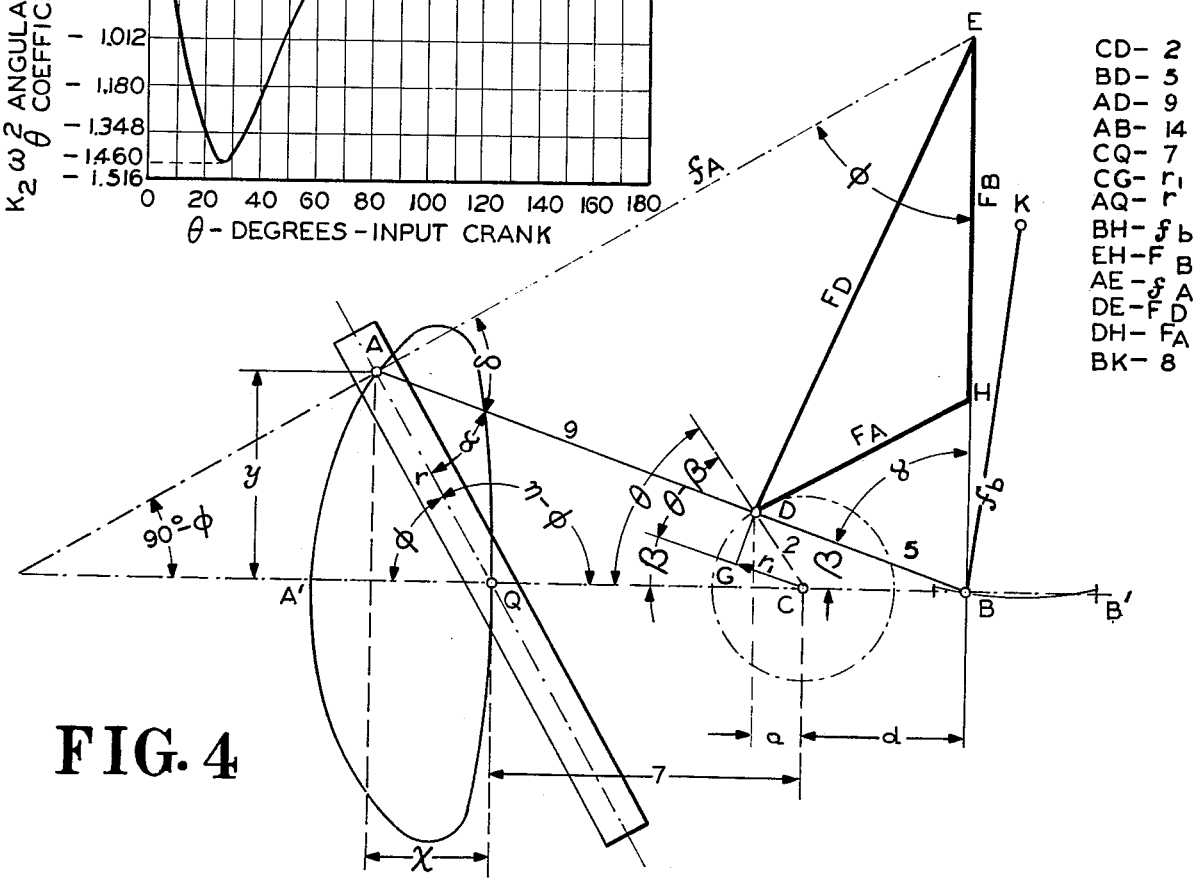
FIG. 4

| | POSITION | CRANK ANGLE $\theta$ | REACTOR ANGLE $\phi$ | PISTON A | REACTOR RA | PISTON A | PISTON B | PISTON B | REACTOR RB |
|---|---|---|---|---|---|---|---|---|---|
| FIG. 10 | 1 | 260° | -90° | 0 | 0 | IGNITION | EXHAUST CLOSES | 180° | 180° |
| FIG. 11 | 2 | 100° | +80° | 80° | 0° | EXPANS | INTAKE CLOSES | 260° | 180° |
| FIG. 12 | 3 | 0° | 0° | 130° | 90° | EXHAUST OPENS | COMP. | 310° | 270° |
| FIG. 13 | 4 | 260° | -90° | 180° | 180° | EXHAUST CLOSES | IGNITION | 0° | 0° |
| FIG. 14 | 5 | 228° | -86° | 196° | 180° | INTAKE OPENS | EXHAUST | 16° | 0° |
| FIG. 15 | 6 | 130° | +86° | 245° | 180° | INTAKE CLOSES | EXPANS. | 65° | 0° |
| FIG. 16 | 7 | 100° | +80° | 260° | 180° | STRATI-FIED CH. START | EXPANS. | 80° | 0° |
| FIG. 17 | 8 | 60° | +63° | 280° | 190° | STRATI-FIED CH. ENDS | EXPANS. | 100° | 10° |
| FIG. 10 | 9 | 260° | -90° | 0° | 0° | IGNITION | EXHAUST CLOSES | 180° | 180° |
| ITEM | 1 | 2 | 3 | 4 | 5 | 6 | 7 | 8 | 9 |

FIG. 18

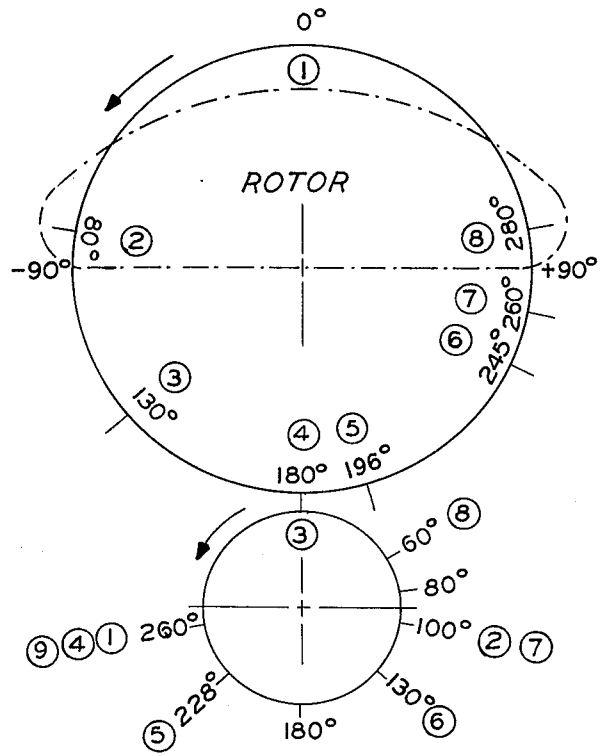

θ - CRANK ANGLES & POSITIONS

FIG. 19

$$(a+d)^2 = 5^2 - (2\sin\theta)^2$$

$$\frac{a+d}{5} = \frac{\sqrt{25-4\sin^2\theta}}{5} = \frac{\sqrt{21+4\cos^2\theta}}{5} = \frac{d+7+x}{14}$$

$$d = \sqrt{21+4\cos^2\theta} - 2\cos\theta$$

$$\frac{\sqrt{21+4\cos^2\theta}}{5} = \frac{\sqrt{21+4\cos^2\theta} - 2\cos\theta + 7 + x}{14}$$

$$\sin^2\theta = 1 - \cos^2\theta$$

$$4\sin^2\theta = 4 - 4\cos^2\theta$$

$$-4\sin^2\theta = -4 + 4\cos^2\theta$$

$$14\sqrt{21+4\cos^2\theta} = 5\sqrt{21+4\cos^2\theta} - 10\cos\theta + 35 + 5x$$

$$5x = 9\sqrt{21+4\cos^2\theta} + 10\cos\theta - 35$$

$$\frac{y}{14} = \frac{2\sin\theta}{5}$$

$$5y = 28\sin\theta$$

$$\tan\phi = \frac{5y}{5x} = \frac{28\sin\theta}{9\sqrt{21+4\cos^2\theta} + 10\cos\theta - 35}$$

$$\phi = \arctan\frac{28\sin\theta}{9\sqrt{21+4\cos^2\theta} + 10\cos\theta - 35} = \frac{28\sin\theta}{\text{ITEM 3}}$$

$$\text{ITEM 1} = \sqrt{21+4\cos^2\theta}$$

$$\text{ITEM 2} = 9 \times \text{ITEM 1} + 10\cos\theta$$

$$\text{ITEM 3} = -35 + \text{ITEM 2}$$

$$\text{ITEM 4} = (\text{ITEM 3})^2 + (28\sin\theta)^2$$

$$(\text{ITEM 4})^2 = \left[(\text{ITEM 3})^2 + 784\sin^2\theta\right]$$

$$\text{ITEM 5} = \frac{-8\sin\theta\cos\theta}{2\sqrt{21+4\cos^2\theta}} = \frac{-4\sin\theta\cos\theta}{\text{ITEM 1}}$$

$$\text{ITEM 6} = 2\sin\theta\cos^2\theta$$

$$\text{ITEM 7} = \text{ITEM 6} - \sin^3\theta$$

$$\text{ITEM 8} = \sin^2\theta\cos\theta$$

$$\omega_\phi = \frac{252\cos\theta\sqrt{21+4\cos^2\theta} - 980\cos\theta + 280 + \frac{1008\sin^2\theta\cos\theta}{\sqrt{21+4\cos^2\theta}}}{(9\sqrt{21+4\cos^2\theta} + 10\cos\theta - 35)^2 + 784\sin^2\theta}\,\omega_\theta = \frac{\text{ITEM 9}}{\text{ITEM 4}}\,\omega_\theta$$

$$(\text{ITEM 4}) \times (-252\sin\theta \times \text{ITEM 1} + 252\cos\theta \times \text{ITEM 5} + 980\sin\theta + \frac{\text{ITEM 1} \times [1008 \times \text{ITEM 7} - (\text{ITEM 8} \times \text{ITEM 5})]}{(\text{ITEM 1})^2}$$

$$\alpha_\phi = \frac{-(\text{ITEM 9}) \times \left[20(\text{ITEM 3}) \times \frac{3.6\sin\theta\cos\theta}{\text{ITEM 1}} - \sin\theta\right] + 1568\sin\theta\cos\theta}{(\text{ITEM 4})^2}\,\omega_\theta^2$$

FIG. 20

ROTARY INTERNAL COMBUSTION ENGINE WITH UNIFORMLY ROTATING PISTONS COOPERATING WITH REACTION ELEMENTS HAVING A VARYING SPEED OF ROTATION

A great many rotary steam and internal combustion engines have been invented over the past one hundred years, but none of them have been found to be practical or useful, excepting the recently invented "WANKEL" engine.

However this engine has a difficult problem of effectively sealing of the rotor and the machining of the rotor housing at present requires special machine tools, and a ring gear and stationary pinion are exposed to high heat.

It is, therefore, a primary object of this invention to provide a rotary engine that is composed of simple components which can be manufactured on standard machine tools at low cost.

A further object of this invention is the elimination of the multi-throw crankshaft of the conventional piston engine.

A still further object is to discard the expensive valve mechanism composed of gears, cams and springs.

It is also an object of this invention to provide an engine which has a constant torque arm compared to the variable torque arm of a crankshaft.

An additional object of this invention is to provide a rotary engine wherein two power pulses occur during each revolution of the rotor.

A final and most important object of this invention is to provide a rotor which can be effectively sealed against compression loss.

FIG. 2 is a section on line 2 — 2 of FIG. 1; with end cover removed;

FIG. 4 shows the diagram of forces, related angles and proportions of the crank and linkage mechanism;

FIG. 5 is a graph showing the crank angles and their corresponding reactor arm angles;

FIG. 6 shows the angular velocity coefficient of the reactor arm for relative angular values of the driving crank;

FIG. 7 shows the angular acceleration coefficient of the reactor arm for relative angular values of the driving crank;

FIG. 8 is a section taken along line 8 — 8 of FIG. 2;

FIG. 18 shows in chart form the various angles and positions of the pistons, reactor arm with the reactor elements, etc.;

FIG. 19 shows the crank angles and rotor positions set forth in FIGS. 10 — 17;

FIG. 20 shows the derivation of the mathematical formulae for computing the angular values, the angular velocity and the angular acceleration of the reactor arm and element.

GENERAL ARRANGEMENT

Figure 1:
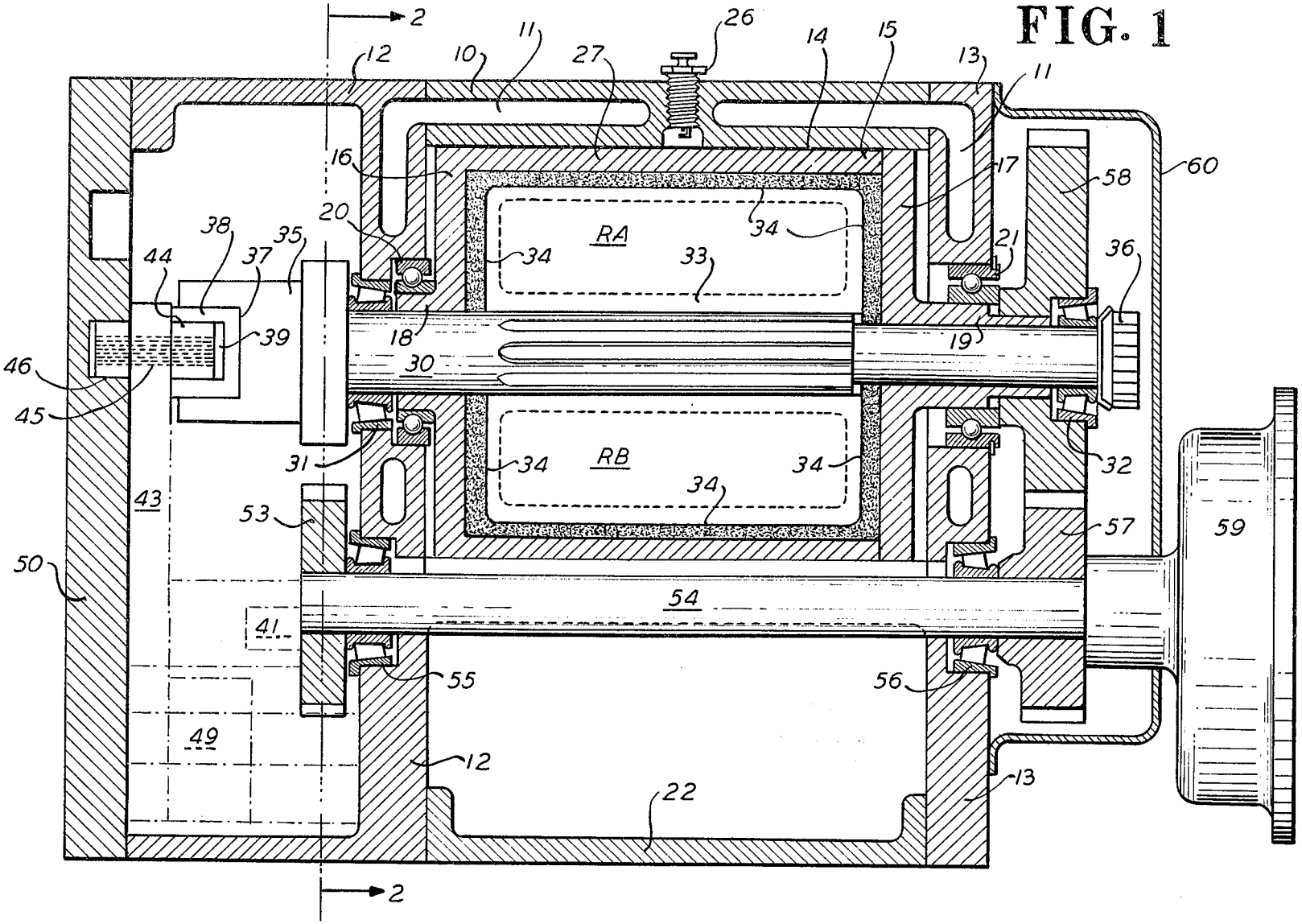
FIG. 1 is a transverse section of the two piston rotor engine, taken along line 1 — 1 of FIG. 2.
Figure 3:
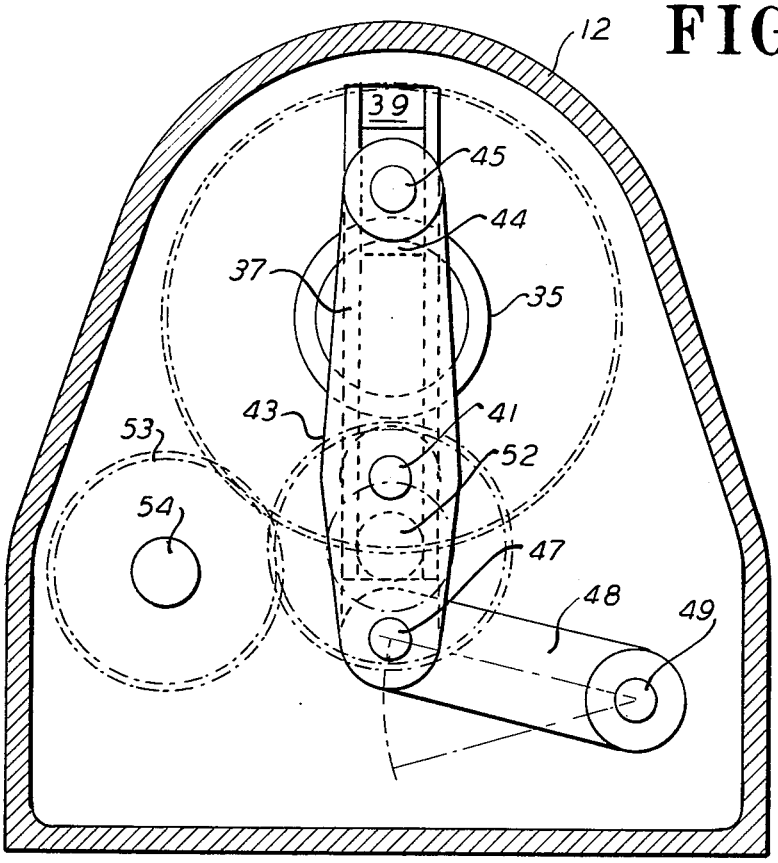
FIG. 3 is a similar section taken on line 2 — 2 of FIG. 1 after 180 degrees of crank rotation.

The structural elements comprising the rotary engine consist of a watercooled housing having a large cylindrical bore in which a hollow rotor with axially spaced side walls is free to rotate and on which two wedge-shaped, diametrically opposed pistons are mounted. These side walls have long hubs carrying ball bearings held in the housing.

The pistons cooperate with similarly shaped reaction elements enclosed in this cylindrical rotor and they are mounted on a multiple-splined shaft, having one external end journalled in a roller bearing held in the housing and a grooved arm secured thereto.

The reaction element has grooves into which seals are fitted to secure a tight compression chamber. The other end of said shaft is journalled in the long hub of one end wall and another roller bearing thereon supports a large gear which is secured to the long hub of the rotor side wall.

This gear meshes with a pinion one-half the size of the gear and this pinion is fastened to a shaft which extends to the opposite side whereon a similar pinion is secured. The shaft is supported on bearings held in the housing. A third pinion is free to rotate on a stud pressed into the housing and this pinion is provided with a crank pin on which a connecting rod is pivoted, one end of this rod being hinged on a link which is supported on a long pin held in spaced frames, while the other end of this rod carries a pin and crosshead which slides in the grooved arm.

A flywheel is fastened to said shaft which rotates twice as fast as the rotor. Suitable exhaust and intake porting is provided in the stationary housing at the proper location. Longitudinal, helical-shaped slots in the rotor serve as passages to or from the rotor to the porting.

One or more spark plugs, projecting thru the housing will ignite the air and gas mixture when the slots of the rotor become aligned with the spark plugs.

The rotary engine may best be understood by dividing it into three units:

1. The rotor unit
2. The reactor unit
3. The gear transmission unit

1. The rotor unit comprises a cylindrical housing 10 which is provided with cavities 11 for cooling water.

Bolted to the housing 10 are the side frames 12 and 13. The housing 10 is provided with a cylindrical bore 14 into which the rotor 15 is closely fitted for rotation therein.

The rotor 15 comprises a side wall 16, a cylindrical body 27 and two diametrically opposed, wedge-shaped pistons A and B integral therewith. Another side wall 17 is bolted to the pistons A and B, thereby forming chambers 28. Side walls 16 and 17 have long hubs 18 and 19 respectively and they are journalled on ball bearings 20 and 21 supported by the side frames 12 and 13. A tie piece 22 joins these two side frames.

The housing 10 has an exhaust port 23 and an intake port 24. On some engines a stratified charge injector may be located at 25. A spark plug 26 is centrally located on the top of the housing 10. Longitudinal, helical slots 29 are cut into the cylindrical body 27, whereby the the internal chambers 28 of the rotor 15 inter-act with exhaust and intake porting of the housing 10.

2. The reactor unit comprises a long, multiple-splined shaft 30 which is journalled on roller bearing 31 supported on the side frame 12 and on bearing 32 supported on spur gear 58, the latter being secured on the hub 19 of the side wall 17.

A long hub 33 is fitted on the splined shaft 30 and the wedge-shaped reactors RA and RB are integral with the hub 33. The back faces of the reactors RA and RB are hollowed out to reduce their weight and their sides and top have a groove for the reception of the seals 34.

On the left hand end of the splined shaft 30 is a hub 35 which bears against the inner race of the roller bearing 31 and on the right hand end of shaft 30 is an adjusting nut and lock washer 36 which is in contact with the inner race of the roller bearing 32, whereby the rotor and reactor are held in their correct location and still allowing for longitudinal expansion due to heating, permitting ball bearing 20 to float, while snap ring bearing 21 is definitely held in place.

Hub 35 is provided with a deep slot 37 into which the reactor arm 38 is fitted, the latter having a deep groove 39. A spur gear 40 carries a crank pin 41 which fits into a bore 42 in a connecting rod 43. A sliding block 44 and a smaller block 46 are integral with a pin 45 which is rotateably mounted on the rod 43.

On a fork of the connecting rod 43 the link 48 is hinged by means of the pin 47, while pin 49 supports the link 48 between frames 12 and 50. The sliding block 44 on pin 45 is fitted into the deep groove 39. A short guide 51 in the end frame 50 controls block 46 only where the conchoidal path described by block 44 crosses the center of rotation of shaft 30, see FIG. 4.

Gear 40 rotates freely on a stud 52, see FIG. 8, secured in the side frame 12. In FIG. 4 the geometrical proportions of the crank and linkage mechanism are indicated in order that it will function as intended.

The member AB represents the connecting rod 43 which is 14 units long, pin 45 to pin 47. The point D, the crank pin 41, on AB is 5 units from point B, or pin 47, hence AD is 9 units long. The crank CD is 2 units, and the link 48, or BK is 8 units long.

This mechanism differs from the mechanism shown in my patent No. 3,482,473 only in respect to the link 48, which replaces the sliding block 52. The latter may be considered as a replacement for a link of infinite length.

Figure 9:
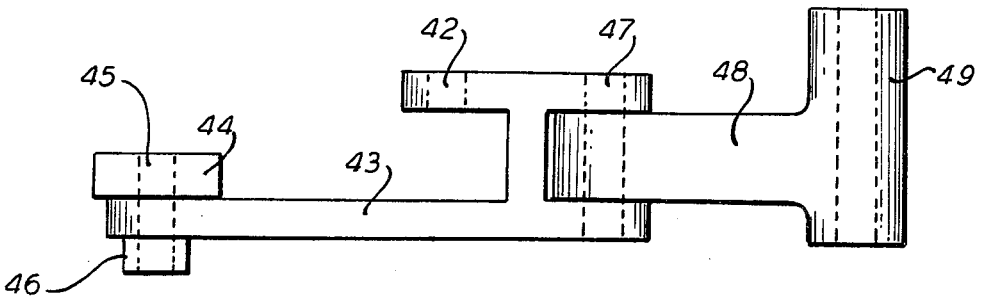
FIG. 9 is a detail of the reactor drive connecting rod and of a link associated therewith.
Figure 10:
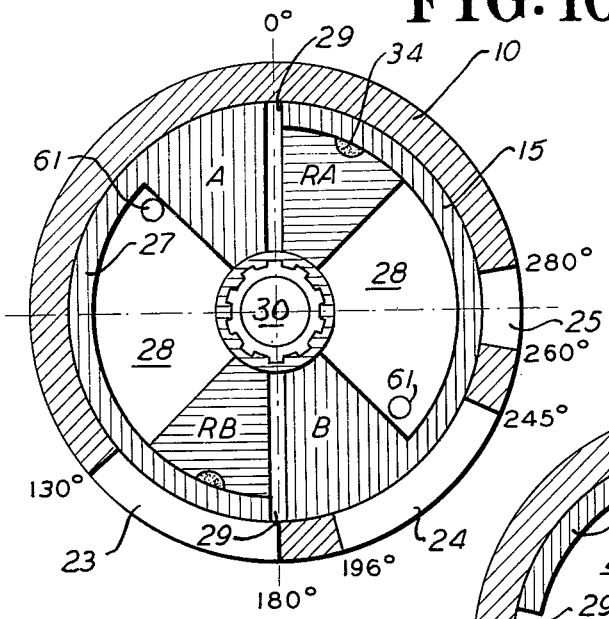
FIG. 10 is a cross-section thru the housing and rotor when the crank angle 260 degrees and the rotor position is 0°.
Figure 11:
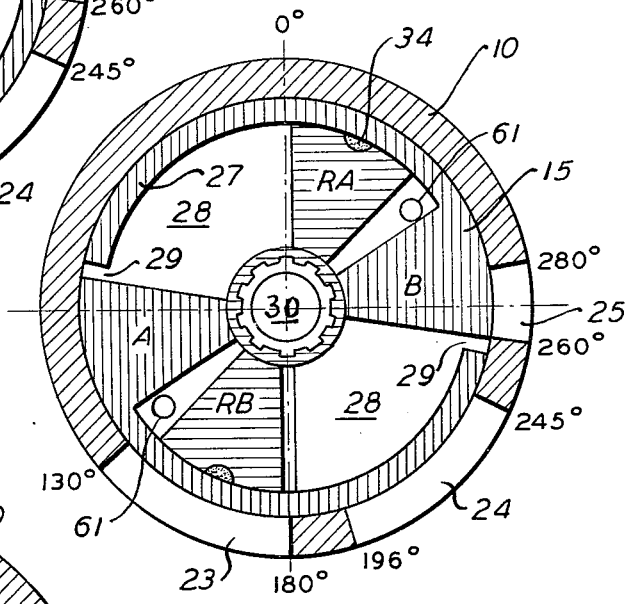
FIG. 11 is a similar cross-section where the crank angle is 100° and the rotor with pistons has turned 80°.
Figure 12:
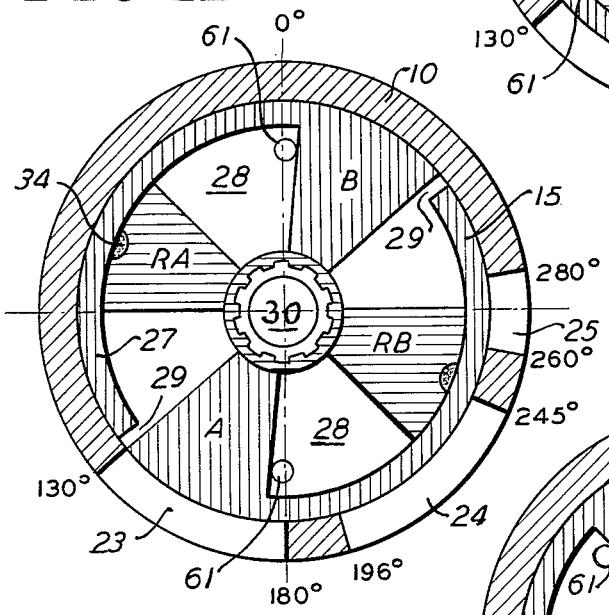
FIG. 12 is a similar cross-section where both the crank angle and the reactor angle is 0°, having turned 90° from the position shown in FIG. 11; and the exhaust port is about to open.
Figure 13:
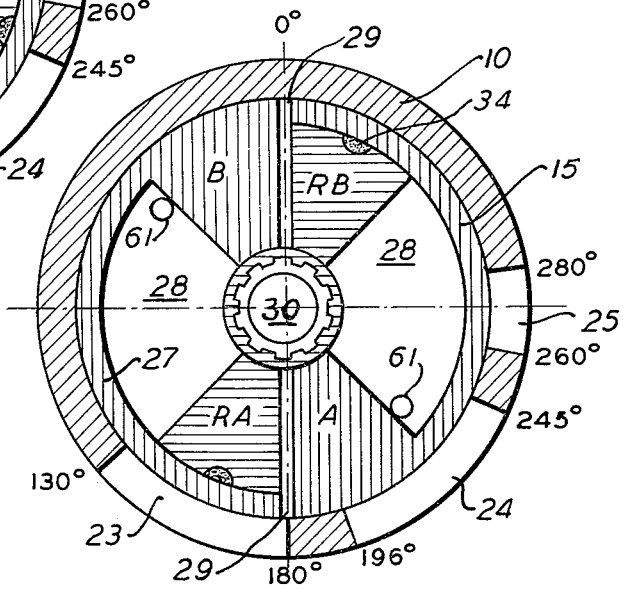
FIG. 13 is a similar section where the crank angle is 260° and the reactor angle is — 90° and the rotor with the pistons has made ½ revolution and the exhaust phase is over.
Figure 14:
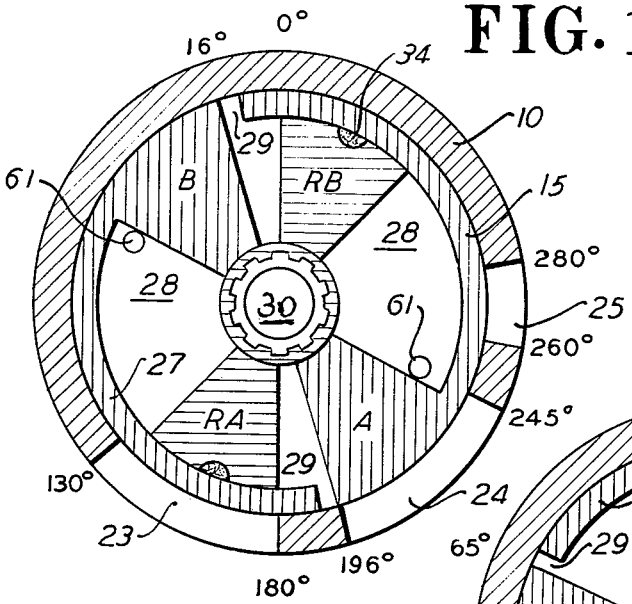
FIG. 14 is a similar section where the crank angle is 228°, the reactor element is still at rest and the piston position is at 196°; and the intake port is open.
Figure 15:
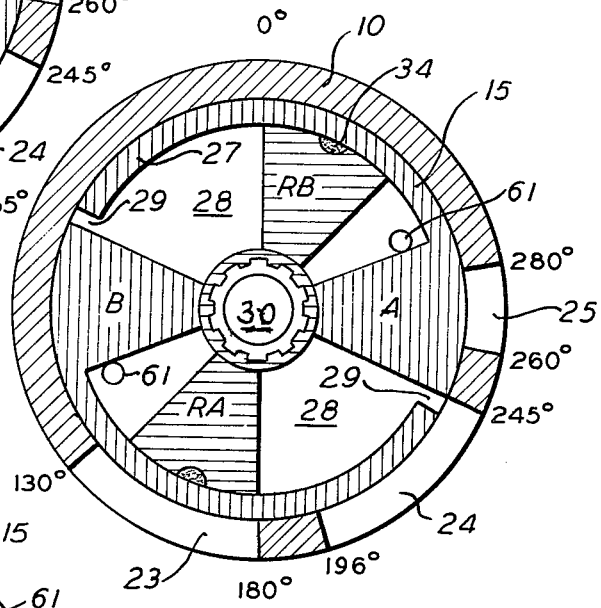
FIG. 15 is a similar section where the crank angle is 130°, the reactor element is still at rest and the piston position is at 245° and the intake port closes.
Figure 16:
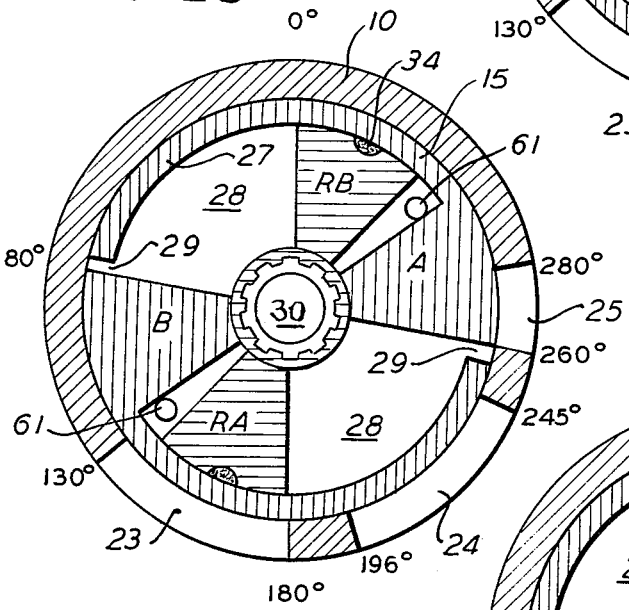
FIG. 16 is a similar section where the crank angle is 130°, the reactor element is still at rest and the rotor is at the stratified charge position at 260°.
Figure 17:
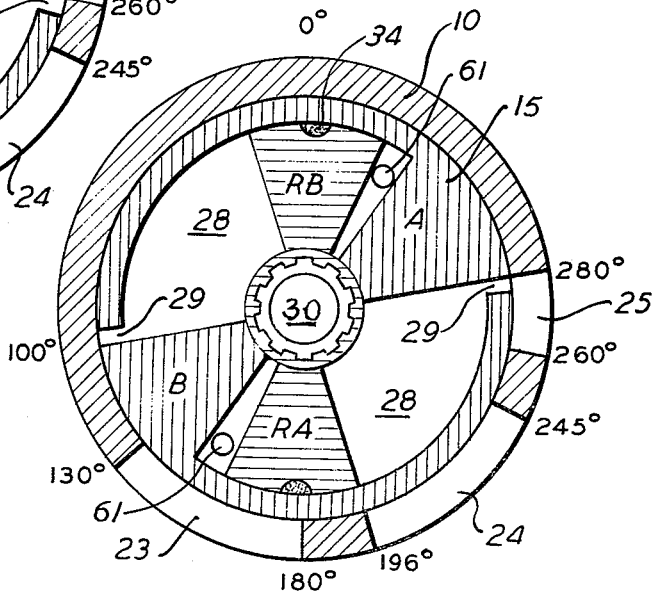
FIG. 17 is a similar section where the crank angle is 100°, the reactor element is at 190° and the rotor with pistons is at 280° and the stratified charge ends.
Figure 21:
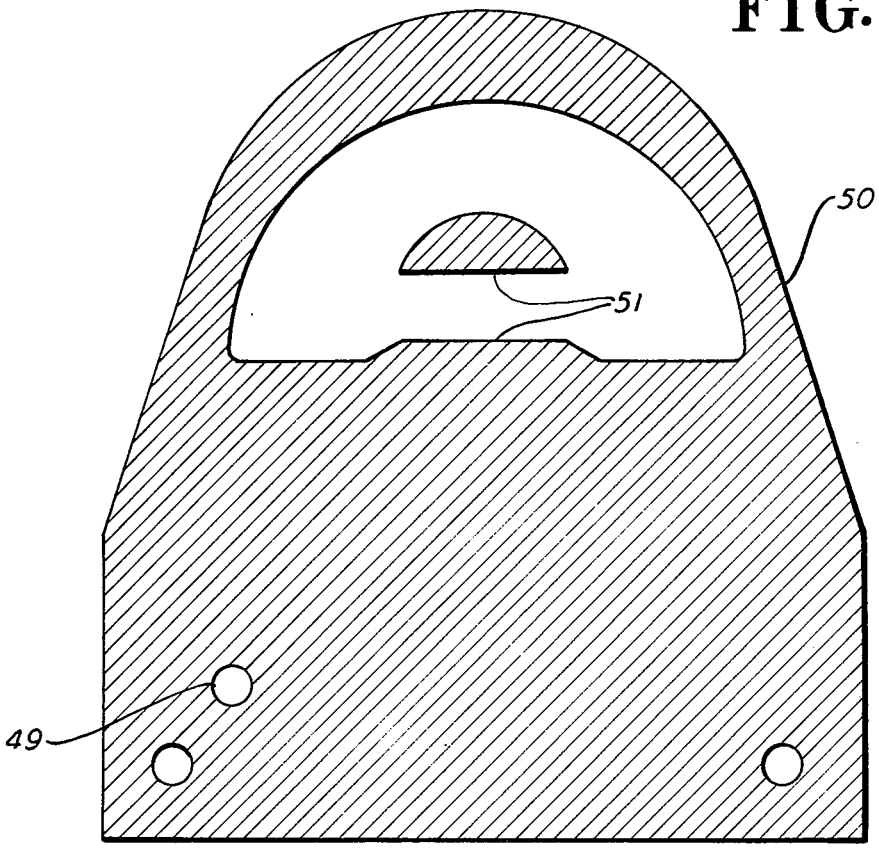
FIG. 21 is a view of the end cover.
Figure 22:
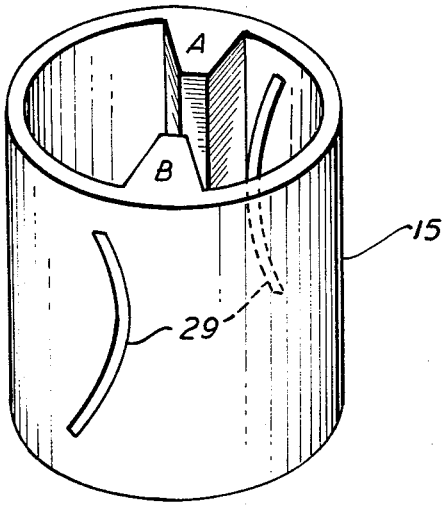
FIG. 22 is a view of the rotor showing an axial, helical slot adjacent each piston face.

FIG. 9 shows the connecting rod 43 and its associated link 48 in detail. This design provides a more rigid construction as compared to the sliding block 52. The replacement of block 52 with the link 48 does not materially affect the values of the velocity and acceleration of the reactor element as computed according to the formulae shown on FIG. 20.

3. The gear transmission unit comprises the gear 53 which mates with the gear 40 and it is secured to a shaft 54 which is journalled on the roller bearings 55 and 56 respectively, and they are supported in the side frames 12 and 13. A gear 57 is also secured to shaft 54 and it is ½ the size of gear 58 which mates with it, therefore, the gear 40 with its crank pin 41 makes two revolutions for each revolution of the rotor 15.

A flywheel 59 is fastened on shaft 54 and a similar nut and lock washer as shown at 36 adjusts bearings 55 and 56. The gears 57 and 58 are enclosed in a case 60.

Since there are two sector-shaped chambers in the rotor there will occur two power pulses during one revolution of the rotor, it follows, therefore, that an engine constructed according to the above description is equivalent to a four cylinder piston engine, or a "WANKEL" engine with two rotors.

The design of the rotary internal combustion engine has been clearly described and illustrated, therefore, it will become obvious to those skilled in the art that various modifications and improvements can be made.

The proportions of the components may, of course, be changed from those stated on FIG. 4, and such changes, modifications and rearrangements shall come within the scope of the following claims.

I claim:

1. A rotary internal combustion engine comprising in combination:

a. a housing having a circular bore, exhaust and intake ports and ignition means, b. two side frames supporting said housing, c. a hollow cylindrical rotor with side walls, axial-helical slots and two diametrically opposed, sector-shaped pistons integral with said rotor and adjacent said slots, d. said side walls having long hubs suitable for mounting ball bearings, a first ball bearing being provided with a snap ring and mounted on one of said side walls, said snap ring bearing against one of the side frames, a second ball bearing mounted on the other hub and having its outer race movably fitted in the other side frame, e. a multiple-splined shaft journalled in said long hubs, said shaft having a shoulder to abut the cone of a first flanged tapered roller bearing and its cup being mounted in said other side frame, f. a large spur gear secured to one of said long hubs, and a second flanged tapered roller bearing, its cup being mounted in said spur gear and its cone being supported on said shaft, the cones of said roller bearings facing oppositely, g. a reactor having two diametrically opposed, sector-shaped elements integral therewith and mounted on said multiple-splined shaft, h. a second shaft mounted on bearings supported by said side frames, i. first and second pinions of equal size being secured at opposite ends to said second shaft, said first pinion meshing with said large gear, j. a third pinion being one-half the size of said large gear, k. a stub shaft secured in its adjacent side frame, said third pinion rotating freely thereon and meshing with said second pinion, l. a pin secured in said third pinion, forming a crank, m. an end cover attached to one of said side frames to enclose said second and third pinions, n. a pin supported on said side frame and said end cover, o. a link pivotted on said pin, p. a connecting rod being pivotted on said link and on said crank pin, said rod having an extension beyond said crank pin pivot, q. a pin secured in said connecting rod extension, r. a radial guide arm secured to said multiple-splined shaft, said arm having a deep groove to receive s. a block fulcrumed on the pin in said rod extension and slideable in the groove of said radial guide arm, and t. a flywheel secured to said second shaft, u. whereby one revolution of said rotor turns said second shaft with flywheel and crank two revolutions and turns said guide arm with its connected reactor only one revolution.

2. A rotary internal combustion engine comprising in combination:

a. a housing having a circular bore, exhaust and intake ports and ignition means, b. two side frames supporting said housing, c. a hollow cylindrical rotor with side walls, axial helical slots and two diametrically opposed, sector-shaped pistons integral with said rotor and adjacent to said slots, d. said side walls having long hubs for bearings mounted in said side frames, e. a multiple-splined shaft, one end of which being journalled on a first roller bearing supported on one of said frames and in the long hubs of said side walls, f. a reactor having two diametrically opposed, sector-shaped elements integral therewith and mounted on said multiple-splined shaft and axial and radial grooves in said reactor for the reception of seals, g. a large spur gear secured to one of said long hubs, a second roller bearing being supported by said large spur gear and said multiple-splined shaft, said shaft being provided with threaded lock means to maintain said roller bearings in position, h. a second shaft mounted on bearings supported by said side frames, i. first and second pinions of equal size being secured at opposite on said second shaft, said first pinion meshing with said large spur gear, j. a stub shaft secured in its adjacent side frame, k. a third pinion being one-half the size of said large gear and freely rotating on said stud shaft and meshing with said second pinion, l. a pin secured in said third pinion, forming a crank, m. said stub shaft being located 3½ times the throw of said crank from the center of rotation of said multiple-splined shaft, n. an end cover attached to one of said side frames to enclose said second and third pinions, o. a pin supported on said side frame and said end cover, p. a link pivotted on said pin, q. a connecting rod being pivotted on said link and on said crank pin, said connecting rod having an extension beyond said crank pin, r. a pin secured in said rod extension, said pin tracing a conchoidal path as said crank rotates, s. a radial guide arm secured to said multiple-splined shaft, said guide arm having a deep groove, t. a pair of blocks integral with said pin in said rod extension, one of said blocks being slideable in the groove of said guide arm, u. a short, horizontal guide in said end cover, said guide being centrally located with respect to the center of said splined shaft, the other of said blocks cooperating with said short, horizontal guide in said end cover, v. whereby said guide arm is controlled when the pin in the rod extension passes thru the turning point of the splined shaft.

3. A rotary internal combustion engine comprising in combination:

a. a housing having a circular bore, exhaust and intake ports and ignition means, b. two side frames supporting said housing, c. a hollow cylindrical rotor with side walls, axial-helical slots and two diametrically opposed, sector-shaped pistons integral with said rotor and adjacent to said slots, d. said side walls having long hubs for ball bearings mounted in said side frames, e. a multiple-splined shaft, one end of which being journalled on a first tapered roller bearing supported on one of said side frames and in the long hubs of said side walls, f. a reactor having two diametrically opposed, sector-shaped elements integral therewith and mounted on said multiple-splined shaft, and axial and radial grooves in said reactor for the reception of seals, g. a large spur gear secured to one of said long hubs, a second tapered roller bearing supported by said large spur gear and said multiple-splined shaft and lock and threaded means on said shaft to position said roller-bearings, h. a second shaft mounted on bearings supported on said side frames, i. first and second pinions of equal size being secured at opposite ends to said second shaft, said first pinion meshing with said large gear, j. a third pinion being one-half the size of said large gear, k. a stub shaft secured in its adjacent side frame, said third pinion rotating freely thereon and meshing with said second pinion, l. a pin secured in said third pinion, forming a crank, m. said stub shaft being located 3½ times the throw of said crank, from the center of rotation of said multiple-splined shaft, n. an end cover attached to one of said side frames to enclose said second and third pinions, o. a pin supported on said side frame and said end cover, p. a link pivotted on said pin, q. a connecting rod being pivotted on said link and on said crank pin, said rod being 2½ times the throw of said crank, said connecting rod having an extension 4½ times the throw of said crank, r. a pin secured in said connecting rod extension, said pin tracing a conchoidal path when said crank rotates, s. a radial guide arm secured to said multiple-splined shaft, said guide arm having a deep groove to receive t. a block fulcrumed on the pin in said rod extension and slideable in the groove of said radial guide arm, u. whereby said third pinion makes two revolutions to one revolution of said rotor, and one revolution of said crank compels said guide arm to make one-half revolution in the same direction as the crank turns.

* * * * *